US009061879B2

(12) United States Patent
Patthey

(10) Patent No.: US 9,061,879 B2
(45) Date of Patent: Jun. 23, 2015

(54) SECURE LIQUID DRUG DISPENSER AND METHOD FOR DELIVERING LIQUID MEDICATION

(75) Inventor: René Patthey, Morges (CH)

(73) Assignee: ETHIMEDIX SA, Les Acacias (CH)

( * ) Notice: Subject to any disclaimer, the term of this patent is extended or adjusted under 35 U.S.C. 154(b) by 206 days.

(21) Appl. No.: 13/635,695

(22) PCT Filed: Mar. 29, 2010

(86) PCT No.: PCT/IB2010/000705
§ 371 (c)(1),
(2), (4) Date: Nov. 29, 2012

(87) PCT Pub. No.: WO2011/121372
PCT Pub. Date: Oct. 6, 2011

(65) Prior Publication Data

US 2013/0068790 A1 Mar. 21, 2013

(51) Int. Cl.
*B65D 35/28* (2006.01)
*B67D 7/08* (2010.01)
(Continued)

(52) U.S. Cl.
CPC ..... *B67D 7/08* (2013.01); *A61J 7/0076* (2013.01); *A61J 7/0409* (2013.01); *A61J 7/0481* (2013.01); *A61J 2007/0445* (2013.01)

(58) Field of Classification Search
CPC ..... B67D 1/04; B67D 1/0412; B67D 1/0425; B67D 7/08
USPC ..... 222/394, 386.5, 399, 95, 105, 400.5, 222/61, 400.8
See application file for complete search history.

(56) References Cited

U.S. PATENT DOCUMENTS

| | | | | |
|---|---|---|---|---|
| 7,316,329 | B2 * | 1/2008 | Wertenberger | 222/105 |
| 7,810,679 | B2 * | 10/2010 | Wauters et al. | 222/399 |
| 2007/0186923 | A1 | 8/2007 | Poutiatine et al. | |

(Continued)

FOREIGN PATENT DOCUMENTS

| | | |
|---|---|---|
| EP | 1 736 190 | 12/2006 |
| EP | 2 025 640 | 2/2009 |

(Continued)

OTHER PUBLICATIONS

International Search Report dated Dec. 22, 2010, corresponding to PCT/IB2010/000705.

*Primary Examiner* — Kevin P Shaver
*Assistant Examiner* — Robert Nichols, II
(74) *Attorney, Agent, or Firm* — Young & Thompson

(57) ABSTRACT

A secure liquid drug dispenser for delivering pre-determined doses of medication for oral administration, including an airtight container (1) pressurized thanks to a micro pump (28) defining a pressurized area (10) in which a flexible bag (13) containing the drug to deliver is attached, the flexible bag (13) being connected to a valve (20) located within a second non pressurized area (21) of the container for delivering doses of drug trough a delivery port (23). A microcontroller within the pressurized area (21) controls the opening of the valve for precise delivery of drug doses and monitors the pressure within the pressurized area (21). The drug dispenser is further equipped with a neutralization subsystem (16) for inactivating the medication contained in the flexible bag (13) and biometrics elements are provided to identify the patient. A method of delivering doses of liquid medication is also disclosed.

13 Claims, 6 Drawing Sheets

(51) Int. Cl.
*A61J 7/00* (2006.01)
*A61J 7/04* (2006.01)

(56) References Cited

U.S. PATENT DOCUMENTS

| | | | | |
|---|---|---|---|---|
| 2011/0259915 | A1* | 10/2011 | Rice | 222/95 |
| 2014/0097201 | A1* | 4/2014 | Otto | 222/95 |
| 2014/0352675 | A1* | 12/2014 | Smith | 123/574 |

FOREIGN PATENT DOCUMENTS

| | | | |
|---|---|---|---|
| JP | 04218165 | A | 8/1992 |
| JP | 2001503302 | A | 3/2001 |
| JP | 2003325440 | A | 11/2003 |
| JP | 3140843 | U | 3/2008 |
| JP | 2009526553 | A | 7/2009 |
| WO | 98/19647 | | 5/1998 |
| WO | 00/54724 | | 9/2000 |

* cited by examiner

SECURE LIQUID DRUG DISPENSER AND METHOD FOR DELIVERING LIQUID MEDICATION

The present invention relates to a hand-held, electronically controlled drug dispenser for liquid medications and in particular a device that allows self administered pre-programmed doses of liquid medication for oral administration. More particularly, the drug dispenser is intended to deliver opioid based analgesic to a patient under well controlled conditions. Another object of the invention relates to a secure method of delivering liquid medication for oral administration.

As it is known, certain types of diseases, or other conditions as well as severe pain management call for medications, several times a day, and the medication dosage to be delivered may vary from one patient to another, and, for the same patient, during the day and from one day to another. Morphine based pain management is accessible to less than 20% of world's population, even though it is the recommended medication for severe pain, according to WHO ladder. There are multiple reasons for this situation, like irrational fears, lack of education, and above all regulations and policies that make morphine a restricted (if not forbidden) drug. In order to overcome those difficulties, many actions are taken by health authorities, governments, NGO's, etc. but the question of a way to distribute morphine safely and at affordable cost is not yet solved. There are several requirements for autonomous delivery of morphine that are briefly summarized hereunder. First one should ascertain that accurate doses of drug are delivered to the right patient without the possibility for someone else to use the drug dispenser. A second requirement is that, in case of an attempt to tamper with the drug dispenser, the active content should be neutralized or inactivated to avoid misuse of the drug contained in the drug dispenser. Lastly, once filled with the drug to be delivered, and programmed by the medical personal, the drug dispenser should be designed in such a way that it may be freely given to patients for self medication without needing any further external intervention. It is an object of the present invention to provide an electronically controlled drug dispenser for delivering liquid medications designed to meet the above requirement, and which in particular, guaranties that the drug is delivered accurately in term of dosage and timing only to a specifically identified authorized patient.

Advantageously the drug dispenser provides a mechanism for inactivating the liquid drug in case of an attempt to tamper with or intrude in the device.

Another object of the present invention is to provide a device that is robust and able to withstand harsh environmental constraints while keeping the manufacturing costs to a minimum. Preferably, the drug dispenser should also have an autonomy of 20 to 30 days without needing a refill so that it may be used both for hospital and home care. Lastly, the maintenance requirements should be kept to a minimum with the objective of providing a low cost reusable device for use during 3 years without maintenance interventions.

A further object of the invention is to provide a method for safely deliver liquid doses of medication to a specifically identified patient.

According to the present invention, a hand-held, electronically controlled drug dispenser is provided for delivering doses of liquid medications; it has the characteristics depicted in claim 1. A method for delivering doses of liquid medication comprising the steps recited in claim 12 is also provided.

Further advantages and characteristics will become apparent from the depending claims and from the following description.

A preferred, non-limiting embodiment of the present invention will now be described by way of example with reference to the accompanying drawings, in which.

Figure 1:
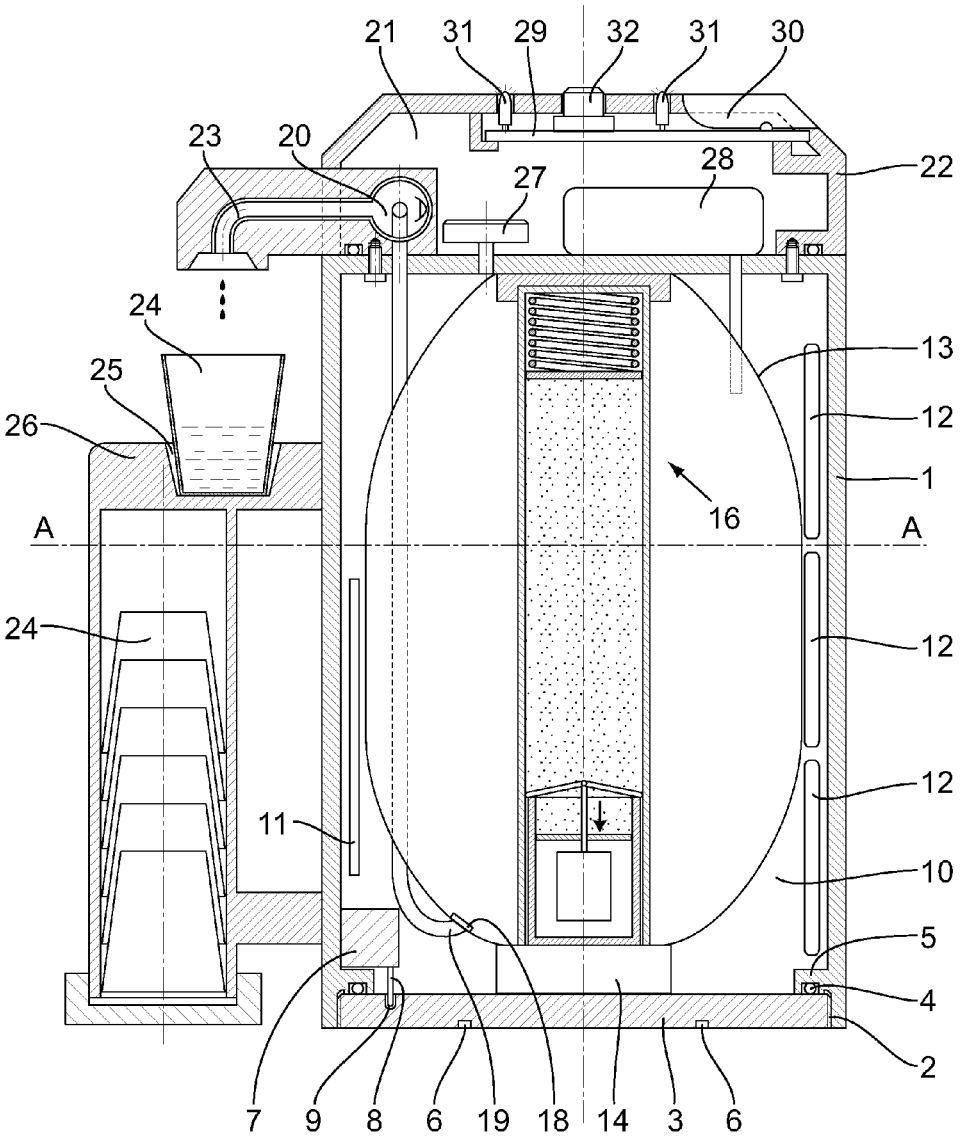
FIG. 1 shows a cross longitudinal view of a drug dispenser according to the present invention.

Referring to FIG. 1, the fundamental idea is the use of a pressurized container equipped with a microcontroller. The drug to be delivered is preferably packaged in a flexible bag fixed within the pressurized area of the container. The delivery of doses is performed under the control of a microcontroller programmed to fulfil the required medical prescriptions by the opening and closing of a valve. The aperture time is calculated by the microcontroller based on nominal flow of the valve, the current pressure, the temperature and other pertinent parameters. In addition to provide the propulsion energy for the delivery of liquid, the use of a pressurized container has two other main advantages. First, considering the security requirement, the level of pressure in the container is permanently monitored by the microcontroller thanks to a pressure sensor and if it shows a sudden pressure drop, meaning an attempt to open the container, the chemical neutralization subsystem it triggered. Secondly, the flexible drug bag being under permanent pressure it prevents any contact between the liquid and the external environment. The drug may only flow through the delivery port avoiding that air or any other small particle penetrates in to the flexible bag. This contributes to excellent hygienic conditions of the device. It also permits a good stability of the liquid solution preventing oxidation and contamination by micro organism. This greatly contributes to the expected long autonomy and reusability of the core device elements.

Another important feature is the biometric access control, implemented in the embarked electronic module. Lastly, for programming and monitoring the drug dispenser, a wireless remote control system using an encrypted communication protocol is provided. All the above characteristics will now be described in greater detail with reference to the figures which illustrates the principle and main components of drug dispenser.

Referring to FIG. 1, the drug dispenser comprises a 100% airtight container 1 defining a pressurised area 10. Preferably the container 1 is of cylindrical shape with an approximate diameter of 120 mm and a height of 180 mm giving an internal volume of around 1800 cc. The container is made of the following materials in order of preference, Plastic, aluminium or stainless steel while obviously other suitable materials may be used. The bottom inner part of the container 1 is provided with an internal screw thread 2 in which a base plate 3 may be screwed for closing the container. For insuring air tightness, an O-ring joint 4 is provided between the base plate 3 and an annular flange 5 located in the bottom of the container. For closing the bottom of the container, alternatives to a screwed base plate may be considered such as bayonet closing means for example. In order to facilitate the fastening of the base plate 3 within the bottom of the container, holes 6 are provided in the outer surface of the base plate 3. A key tool with corresponding pins (not shown) may then be used to screw the base plate within the container body.

A locking mechanism is provided in the bottom of the container for locking the base plate 3 once screwed within the base of the container. This locking mechanism comprises an electric actuator like a solenoid 7 driving a rod 8 cooperating with a corresponding hole 9 provided in the base plate 3. In idle conditions, the rod 8 is normally in the hole 9 and will move out approximately 3 mm when the current is applied to the solenoid. Said hole 9 in the base plate 3 is positioned in such a way that once the base plate 3 is in place, closing the bottom of the container, the rod 8 will automatically enter the hole 9 thus locking the base plate. This is achieved by dimensioning adequately the number of threads within the body of the container. In order to remove the base plate 3, the operator will have to activate the solenoid 7 so that the rod 8 is retracted from the hole 9. While the solenoid is energized, the rod 8 is retracted and the base plate 3 may be unscrewed from the container. This locking mechanism provides safety as the container may only be opened by an authorised operator having a remote controller for giving a release order to the microcontroller located within the container which in turn will activate the solenoid. The release order is preferably transmitted to the embarked microcontroller using encrypted key.

The container 1 further comprises, within the pressurized area 10, an electronic printed circuit board (PCB) 11 which will be described in further detail later on, as well a power supply subsystem 38 comprising packs 12 of batteries 46 for supplying energy to the printed circuit board 11 and to the other devices located within the container.

Within the pressurized area 10 of container 1, the drug to deliver is packaged in a flexible, bendable plastic bag 13. The approximate volume of the flexible bag 13 is around one liter. In the central part of the flexible bag, a neutralisation subsystem 16 is arranged and will be described in detail later on. In its lower portion, the flexible bag comprises a refill access closed by a tap 14.

A delivery outlet 18 is arranged in the bottom portion of the flexible bag 13, near the refill access and a delivery pipe 19 connects the outlet 18 to a delivery valve 20 located in the non pressurized upper part 21 of the container.

The container 1 comprises in its upper portion, an area 21 closed by a cover 22. Preferably, the cover 22 is screwed from the inner part of the container 1 so that it may only be removed by the interior of the container once the base plate 3 has been unlocked. This upper portion 21 is usually not pressurized and contains the following components. First, a delivery subsystem comprising a precision valve 20, connected on one hand to the delivery pipe 19 connected to the outlet 18 of the flexible bag and on the other hand to a delivery port 23 through which the liquid drug contained in the flexible bag 13 may flow into a delivery cup 24. Advantageously, the delivery cup 24 is maintained in a recess 25 of the upper part of the handle 26 of the container. The handle 26 attached to the periphery of the container has a hollow section that provides room for additional spare delivery cups 24.

In a preferred embodiment, the valve 20 is a bi-stable (latching) solenoid valve. It is usually a surface mounted device that requires an interface block in plastic or aluminium to connect in and out pipes. The bi-stable characteristics of the valve is advantageous in that it needs to be energized only at the beginning and at the end of the delivery process thus allowing considerable saving of energy compared to a mono stable valve type which needs to be energized during the whole delivery process.

Within the upper portion 21 of the container, a pressure sensor 27 is arranged for monitoring the pressure level within the lower pressurized area 10 of the container 1. Preferably, a differential sensor is used for measuring the pressure difference between its two openings. The pressure sensor 27 is placed in the upper portion of container, with the "high pressure" inlet directly plugged into a hole in the upper wall of the container. An air pressure mini pump 28 for pressurizing and maintaining under pressure the inner part 10 of the container 1 is installed in the upper area 21 of the container.

Within the upper space 21 closed by the cover 22 are also arranged the components forming the user interface of the drug dispenser. A printed circuit board 29 comprises the logic for a finger print sensor 30 accessible from the exterior of the device. Four LEDs 31 (light emitting diodes) as well as a push button 32 enabling the user to receive signals and to interact with the drug dispenser are connected to the printed circuit board 29 and emerge from the cover 22.

The printed circuit board 29 also comprises the necessary electronic components and circuitry to enable an infrared transmission with a remote controller. Preferably, the transmission between the remote controller (not shown), which may be a personal computer, a smart phone, a personal digital assistant or a any other dedicated controlling device will be performed with an encrypted secured telecommunication protocol to enhance the security of the device. While infrared communication is foreseen it is obvious that several other wireless communication technologies could be used as by way of example Bluetooth, WiFi, GSM, RFID amongst others. A wired communication link with a cable and an adequate RS232 or USB plug may also be envisaged to establish a communication path between the drug dispenser and the remote controlling device.

To open the remote dialog with the drug dispenser, the control computer uses an encrypted login procedure; this ensures that the device is strongly protected against non authorized attempts.

All possible data exchanges between the drug dispenser and the remote controller are then possible, like:

- lock/unlock the drug dispenser base plate 3)
- enable disable neutralization subsystem
- enroll patients and caregivers (read and store their fingerprints)
- upload the prescription and dosage protocol
- read the activity journal maintained by the drug dispenser
- monitor the status at any time (dose taken, remaining liquid level, etc.)
- handle maintenance and technical tasks (calibration, software update.)

Figure 2:
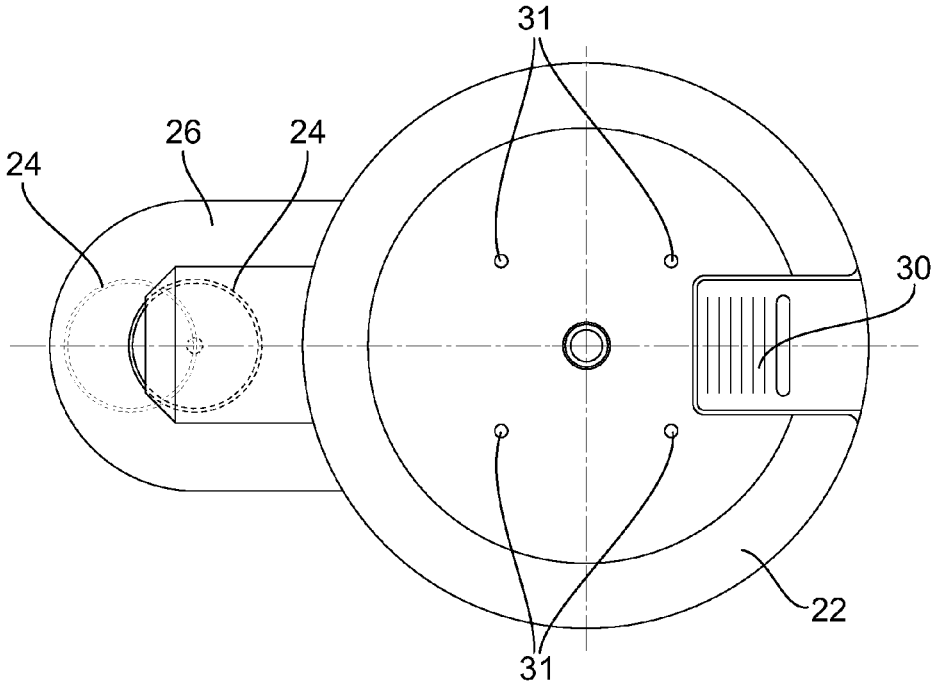
FIG. 2 is a top view illustrating the cover the drug dispenser.

FIG. 2 shows a top view of the drug dispenser on which the four LEDs 31 are illustrated as well as the push button 32. The finger print sensor 30 is preferably arranged in a recess of the cover 22 allowing a precise guiding of the user's finger.

Figure 3:
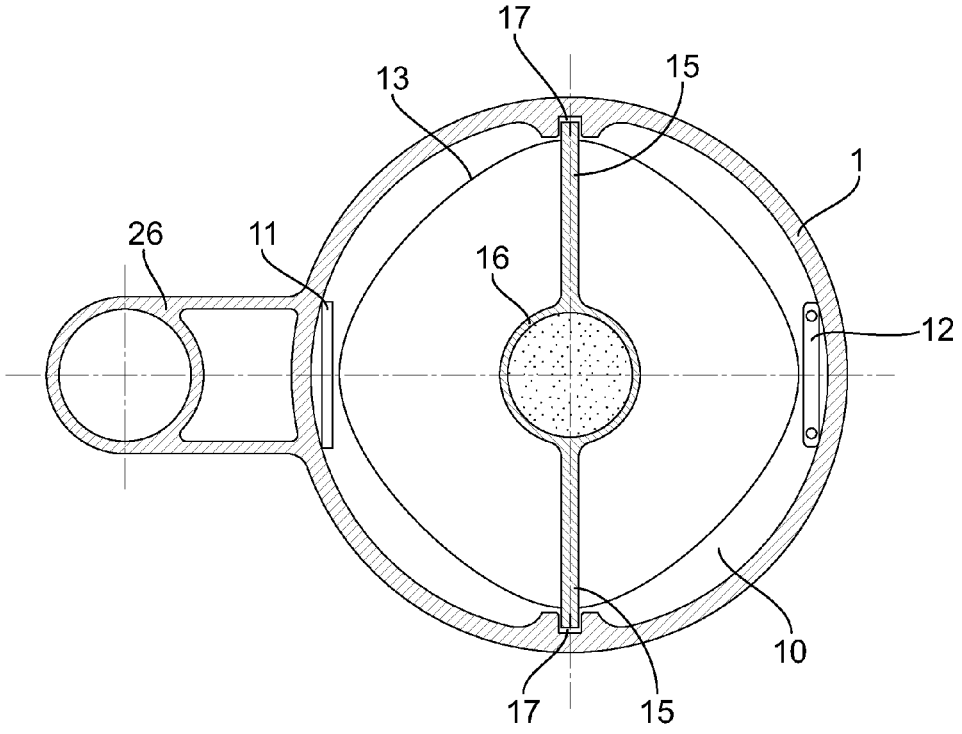
FIG. 3 is a cross sectional view taken along line A-A of FIG. 1.

FIG. 3 is a cross sectional view of the container 1 along line A-A of the FIG. 1 illustrating the flexible bag 13 containing the drug to deliver and the neutralisation subsystem 16. The flexible bag 13 comprises rigid frames 15 that interact with the longitudinal grooves 17 arranged in the body of the container for securing the flexible bag 13 within the pressurized area of the container and maintaining the neutralisation subsystem 16.

Figure 4:
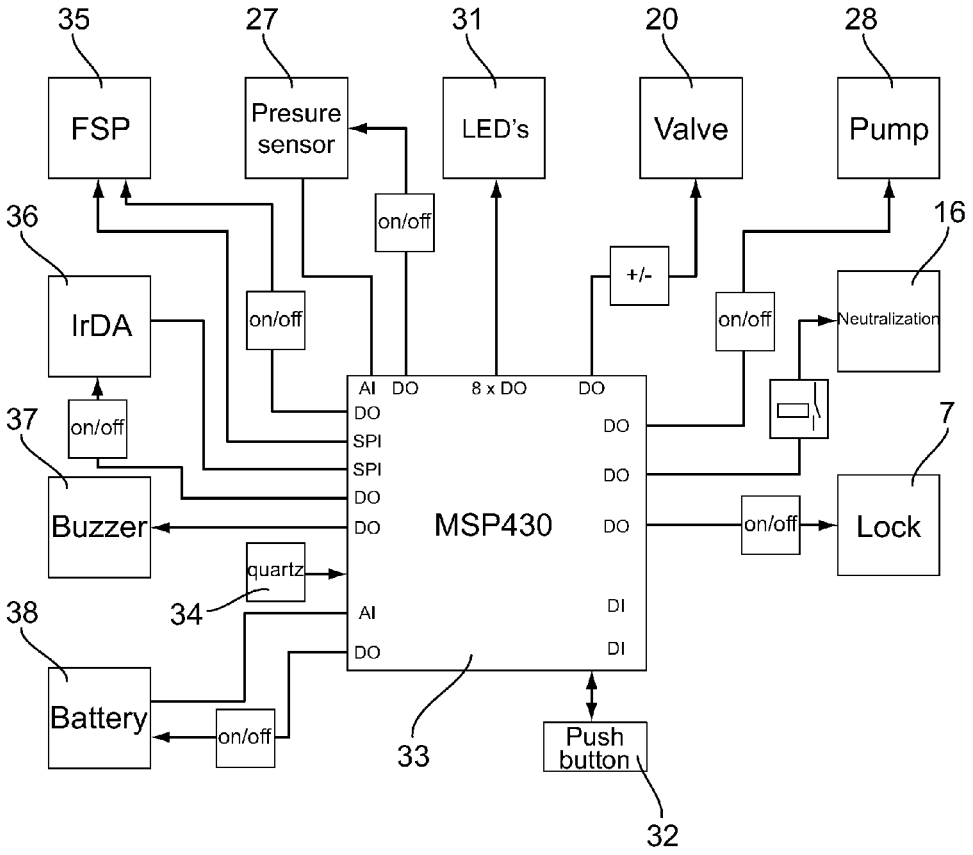
FIG. 4 is a schematic view of the electronic logic of the drug dispenser.

With reference to FIG. 4, the main components of the electronic printed circuit boards (11,29) will now be schematically described. In the figures, the following symbols have been adopted: DO refers to a digital output, DI to a digital input, AI to an analog input and SPI to a serial I/O port. A microcontroller 33 located on the printed circuit board 11 within the pressurised area 10 of the container is used to control and monitor the different devices enabling the various functions of the drug dispenser.

The electronic logic is based on a Texas MSP430 microcontroller 33 but obviously other equivalent microcontrollers could have been chosen. The chosen controller has a built-in temperature sensor which is used to monitor the environmental temperature. Temperature monitoring is needed for two main purposes: The temperature within the pressurised area 10 of the container is permanently monitored to avoid an attempt to freeze the drug contained in the flexible bag 13. As it will be seen later on, the neutralisation subsystem 16 works only if the drug is in liquid phase within the flexible bag 13. Therefore, monitoring the temperature allows triggering the neutralization device 16 if the temperature comes close to zero degree Celsius for a few minutes, thus preventing an unauthorized extraction of the drug in solid state.

The second purpose of temperature monitoring is to allow temperature compensation for the calculation of the flow rate of the delivery valve 20. As flow depends on viscosity which depends on temperature, there is a need to adjust the opening time of the delivery valve 20 for an accurate distribution of a drug dose.

The monitoring of the temperature may also be useful for other usages, like for example, the compensation of the pressure sensor 27 if a low cost uncompensated sensor is used.

The microcontroller 33 uses an external 32,768 kHz watch crystal 34 and a counter to provide real time clock (RTC), time of the day (TOD) and calendar functionality. The counter is also used to implement small execution delays (e.g. to allow a peripheral to power up), to blink the LEDs 31 and to implement timeouts for example when the button 32 is pushed, or when the drug dispenser is waiting an action from the user.

The fingerprint subsystem consists of a chipset located on the printed circuit board located in the cover 22 including: a Fingerprint Security Processor 35 (depicted as FSP on the figure) and the finger print sensor 30 emerging from the cover 22. A possible configuration for this device is an Atmel type FSP FP105 with a fingerprint sensor type AT77C104B. The fingerprint sensor 30 is connected to the FSP 35, which in turn is connected to the microcontroller 33 via a serial I/O using 4 wires. It also needs one generic general purpose I/O pin for RESET and a second one with interrupt capabilities for a BUSY signal. The FSP 35 does not have a shutdown/sleep mode, and draws several milliamps when idle. Preferably, its power supply needs to be shut down when it is not in use, which requires an additional general purpose I/O pin and an on/off switch.

An infrared communication subsystem 36 used to communicate with a remote controller device is also mounted on the printed circuit board 29 located in the non pressurized area 21 of the cover 22. The infrared communication subsystem may consist of a low-power IrDA 1.2 compliant transceiver, such as the Sharp GP2W0116YPS, connected to one universal asynchronous receiver transmitter unit of the microcontroller 33. One additional general purpose IO pin is used to put the transceiver in shutdown mode.

An optional buzzer 37 may also be installed on the printed circuit board 29 located in the cover 22. The buzzer may be activated for specific alarms. A typical use is to emit a beep during delivery when the drug level is below minimum informing the patient that the device needs to be refilled at the hospital or authorized pharmacy. It can also be activated to warn the pharmacist for some wrong manipulation during refill or maintenance operations.

Figure 6:
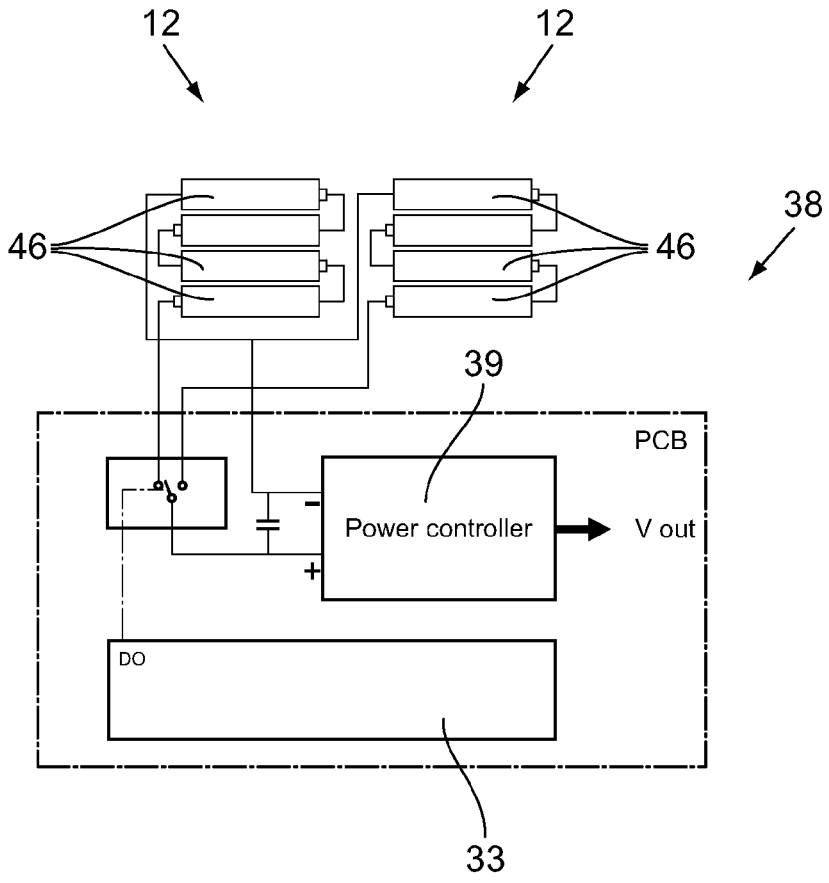
FIG. 6 is a view of the power supply subsystem used to energize the drug dispenser.

The power supply subsystem 38 is based on ordinary, low cost AAA 1.5 volt cells, to provide 6 volts (4 cells), 9 volts or others. It is expected that enough energy is embarked in the bottle for the full life time: estimated 4,000 doses delivered, in about 3 years (based on an average of 30 sessions of one month, with a 80% duty cycle, i.e. the bottle is 30 times 1 month in patient's hands and 6 months on the shelf). The initial evaluation of power consumption gives a "pessimist" estimate of about 1600 mAh over full life time. A conservative guess is that 2200 mAh of embarked energy should be sufficient, provided that the leakage is not too high. The leakage means the fact that a battery in use will loose energy even with no or extremely low charge. Consequently, in order to avoid loss of energy due to leakage the energy subsystem 38 comprises two or more sets 12 of cells 46 as depicted at FIG. 6. The drug dispenser starts its life with a first set 12, leaving the second set 12 untouched, thus avoiding lost of energy due to leakage. Under pre-determined conditions, the microcontroller 33 will switch on the second set 12 which is still fully loaded. This will insure that the device and specially the critical components like the neutralisation subsystem 16 have enough energy to be activated until the end of life of the device.

The power supply is conditioned and controlled with the appropriate power controller circuitry 39, in order to ensure a stabilized supply for the critical components (pressure sensor) and the necessary voltage Vcc for the electronic components (msp430, IrDA, FSP, . . . ). This controller 39 also takes care of power-on, reset, standby, etc. For the switching from one set 12 of batteries 46 to the other, there are basically three choices:

1. Manual switching from one set 12 to another during refill operations based on a warning from the microcontroller.
2. Arbitrary switching from one set 12 to another set after having delivered 2000 doses corresponding to the estimated midlife of the drug dispenser. This method is extremely simple, as it requires no additional hardware. It is just needed that the firmware keeps a protected counter of cumulative doses delivered, and activates a digital output signal for switching to the next set when 2,000 doses are reached.
3. Sense the Vcc voltage using an analog input of the microcontroller 33 and switch to the next set 12 when a "low battery" threshold is reached. This however requires an A/D converter port, and some more sophisticated programming, but it is much more efficient being based on actual power usage. This takes into account unexpected energy consumption like for example additional pumping due to pressure loss of the container.

An alternative to the third method above could be that the power controller chip 39 is provided with a "low battery" signal that can be used to switch, without the need of involving the microcontroller 33. In either case, the switching must be performed without any power break to avoid a reset of the microcontroller, which is strictly forbidden during a session).

The functional diagram of the energy subsystem is depicted in more detail at FIG. 6.

Figure 5:
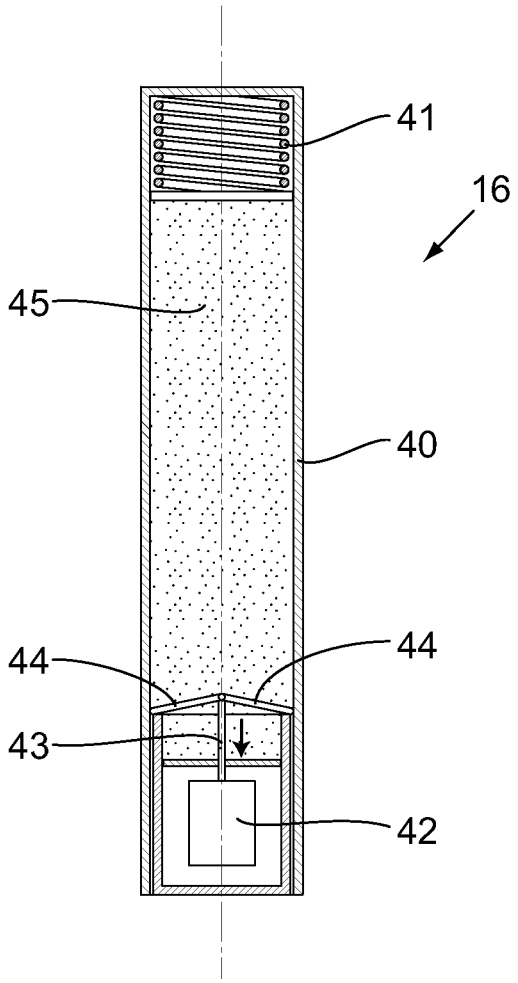
FIG. 5 is a detailed view of the neutralisation subsystem incorporated in the drug dispenser according to the present invention.

The neutralization subsystem 16 illustrated in more detail at FIG. 5 consists of a of a glass pipe 40 full of a neutralisation material 45. In case of delivering a morphine solution, the neutralisation material will consist of particles of active carbon of a specific size. The glass pipe 40 comprises at its upper end a loaded spring 41 that compress the neutralisation material. The bottom end of the glass pipe 40 comprises an electric actuator 42 like a solenoid acting on a rod 43. This rod 43 is articulated to a lever system 44 that, upon activation, will break the glass pipe. Once the actuator 42 is energized, the rod 43 is moved downwardly in the direction shown by the arrow and acts on the levers 44. Thanks to this lever system, the force applied on the inner surface of the glass pipe 40 is amplified and provokes the breaking of the glass tube. If necessary, a weak point in the glass tube may be provided in the vicinity of the levers 44 to ensure that the glass pipe will break upon activation. Such a weak point may for example consist of a smaller diameter of the glass pipe wall in said region. It may also be obtained by sawing a portion of the external surface of the glass.

Typically, the electric actuator 42 may be configured as a solenoid that is "overpowered" with a pulse of several milliseconds. For example, a solenoid sold by Bicron under the model nr SP2515P provides a linear force of 25 newton resulting in a force of around 300 newton at the extremity of the levers 44. The solenoid is preferably directly connected to the last battery set 12 using a simple reed relay or a power MosFet; this insures that the neutralisation subsystem may be activated until the end of life of the drug dispenser.

Upon activation of the neutralisation subsystem 16, once the glass tube is broken, the neutralisation material 45 is propelled under the action of the spring 41 and disseminated very quickly within the flexible bag containing the liquid solution.

Should an event occur that requires activation, typically a sudden pressure drop or an attempt to freeze the container, indicating a tampering attempt of the container, the actuator 42 is energized and the carbon material is mixed in the morphine solution thus neutralising its pharmaceutical properties. In case of such an event the drug dispenser is put in "system fail mode" and must be returned to distribution centre for a full cleaning, refurbishing or replacement.

Pressure is maintained within the pressurised area 10 of the container 1 thanks to the micro pump 28 at a nominal pressure of 350 mbar. The microcontroller 33 permanently monitors the pressure thanks to the pressure sensor 27. Activation of the pump 28 is started when pressure drops below 300 mbar, and stops at 400 mbar. The pump is located as previously seen within the non pressurized area 21 of the cover 22 and is activated by the microcontroller 33 using a digital output bit. Signal conditioning may be done using a MosFet switch.

The valve 20 is a critical component of the device. It delivers the drug based according to the prescription scheme downloaded in the microcontroller's memory as will be explained later. The valve is opened for the necessary period of time to reach the exact volume of drug to be delivered based on several parameters evaluated in real-time by the microcontroller 33. The variable parameters that need to be taken into account to obtain an accurate dosing are:

Current pressure in the container at the beginning of the aperture

Pressure drop during the delivery

Temperature of the liquid (effect on viscosity)

Gravity effect depending on liquid level in the container

In addition, there are several static parameters that are set using per device calibration at factory:

Valve flow characteristic

Pipes and connectors flow characteristics

Plastic bag elasticity and bending (deformation) resistance

High-end solenoid valve: like for example the Lee LHDA0521111H model, a mono-stable, 3-ways, 5V valve may be used for this purpose. This implies that the valve command is based on a simple activation of the digital output port, for the time that the valve has to be open. In case of mono-stable, it is a direct connection through a switching MosFet.

As previously discussed, for energy considerations, a latching (bi-stable) solenoid valve is preferred because the valve needs to be energized only during the opening and closing of the valve. In this case the valve command requires a control circuit to produce the +5V/10 ms pulse for opening (raising edge of the DO signal), and −5V/10 ms (inverted polarity) for closing (falling edge of the DO signal).

The drug dispenser user interface is based on 4 bicolour LEDs (green/red). LEDs are connected to the printed circuit board 29 located on the top of the cover 22. If necessary, a short fibre optic rod could be used to conduct the light to the top cover. The user interface further comprises a push button 32 located on the top of the cover 22. This button is used for interacting with the drug dispenser as will be seen later.

The last component to be described is the pressure sensor 27. The pressure has to be measured in permanence with a fair level of accuracy as it is used to compute the flow rate of the valve, and therefore the accuracy of the dose delivered. The pressure range within the pressurised area 20 of the container will be between 0 mbar (relative to atmosphere) up to 500 mbar. The pump will go up to 400 mbar, and the 100 mbar margin is to take into account the possible effect of temperature, for example if the bottle is exposed at sun, in hot regions. Very high accuracy is not necessary as the dose delivery has a tolerance of +/−10%). It is estimated that a +/−5 mbar precision for pressure is enough, provided the system has been well calibrated at the beginning (the nominal flow of the valve at 350 mbar has a variation of about 0.2% per mbar; a 5 mbar error generate 1% error on flow, which is acceptable). At each dose distribution, the volume decrease has to be compensated. The pressure sensor monitors the pressure drop and informs accordingly the microcontroller 33 which, if necessary, activates the micro pump 28.

Now that the main components of the drug dispenser have been described in detail, the following text will concentrate on the functions provided by the hardware as well as the operating mode of the drug dispenser.

First, the drug dispenser is opened as previously explained by coupling the drug dispenser with a remote controller or a personal computer either by wireless communication or thanks to a cable connecting both devices. A release order is then sent to the microcontroller 33 which will in turn unlock the locking mechanism 7 allowing the removal of the base plate 3 closing the container. The medication in liquid form corresponding to a set of doses to be delivered is prepared and filled in flexible bag 13, the latter is then inserted in the container. The container is closed by screwing the base plate 3 and locked by the means of the locking mechanism 7. Once this is done, the detailed prescription scheme (posology) is downloaded within the micro controller using the communications means.

By prescription scheme, it is meant all the parameters for delivering safely and reliably a specific number of doses to a given patient during a defined time interval. The prescription scheme must specify not only the amount (in mg) of morphine that should be delivered at each activation of the drug dispenser, but also the delay between two consecutive deliveries of drug dose. After completing the delivery of a dose, the drug dispenser will enter into a lockout mode. In this mode, any attempt by the patient to access the device will be denied. Successive doses can only be delivered after a prescribed delay (lockout time) has elapsed. Both the dose (amount in mg of drug to be delivered) and the lockout time are fixed set of parameters for the duration of a prescription, that is from the time the device is handed-over to the patient until he comes back to the distribution centre, either to refill the bottle and/or to get a new prescription with other parameters.

Thanks to the microcontroller, more sophisticated prescription schemes can be foreseen as briefly described hereunder. It is necessary to have certain flexibility around the regular dose prescription scheme depicted above. An additional quantity of drug (bolus) may be available to the patient at any time (i.e. even during the lockout time) if needed. Of course, this "special" availability must be strictly controlled so that the overall daily quantity delivered never exceeds a determined amount. This additional dose, hereafter referenced as the "breakthrough dose" has to be decided by the clinician. The parameters to be determined are the dose in mg of morphine and the number of allowed breakthrough doses per day. In this case, the timing is absolute, based on a solar day. The microcontroller of the device counts the number of breakthrough doses from 0 am to 24 pm and upon reaching the predetermined number of breakthroughs, the drug dispenser will deny any additional doses until the next day. The relation between the regular and the breakthrough dosage is not restricted because of technical reasons; the clinician is free to determine different unitary doses for normal and breakthrough doses. Furthermore, it may also be foreseen that the breakthrough dose will not be available to the patient alone. In this case, a so called caregiver or family authorized member must be present and will have to identify himself to the drug dispenser with his personal biometric signature.

In summary, the breakthrough dose is only available:

- during the lock-out interval of the regular dose
- at the minimum one hour after the previous breakthrough dose
- a limited number of time per day
- with a double biometric check-in (patient and caregiver).

The different modular prescription schemes will insure that a patient will only be able to access the device at specific time interval and will receive only a dose of the predetermined quantity avoiding the possibility of over dose.

Once the drug dispenser is programmed according to the determined prescription scheme, the patient's fingerprint is read by the fingerprint sensor and memorized in the memory of the microcontroller. If necessary, according to the prescription scheme depicted above, the fingerprint of the caregiver is also acquired and memorized. The container is then pressurized to a nominal pressure of around 350 mbar by actuating the pump. The drug dispenser may then be given to the patient for autonomous treatment.

In operation, the patient must first identify himself by applying his finger on the fingerprint sensor 30 then its fingerprint is compared to the fingerprint stored in the memory of the microcontroller 33. In case of a successful authentication, the microcontroller will verify that the patient is authorized to take a dose of medication by comparing the elapsed time since the last delivery. If the timing is correct, according to the prescription scheme downloaded in the microcontroller's memory, a determined dose of medication will be delivered by opening the valve during the necessary time to reach the correct volume of drug.

The user interface, as previously described comprises 4 bi-colour LEDs that may be used to help the patient to interfere with the device, giving him information based on a simple scheme. When the patient needs a dose, he pushes the button 32 located on the top of the cover of the container and if the device is ready to deliver a dose, according to the prescription scheme, a green LED will be activated, informing the patient that the delivery process is about to start. The same applies for example with a red LED illuminated if for example the device is in its lockout state. Other conditions, like the fact that the device is near empty and needs refill at he prescription centre, may also be communicated to the user by a flashing red LED.

As previously said, the pressure is continuously monitored for two purposes. Firstly if the pressure drops under a predetermined threshold, the pump will be activated so as to keep at any time the necessary pressure to deliver the next dose. Secondly, if a sudden drop in pressure is detected, this will be interpreted as an unauthorised attempt and the inactivation subsystem will be immediately triggered, thus neutralising the active substance in the flexible bag.

Neutralization must be effective as quickly as possible (in the range of 10-15 sec. after an intrusion was detected). In relation with the described use of the device for autonomous pain management by delivering doses of a solution of liquid morphine, the neutralization procedure consists in mixing as uniformly and as quickly as possible active carbon powder with the drug solution.

The study was based on the hypothesis of a one liter flexible bag containing an aqueous solution of 5 g of morphine, the highest concentration to be considered. Measures have demonstrated that above 95% of the morphine can be removed at room temperature within the expected delay by means of 40 grams of a high quality active carbon, commercially available, with particle diameters having a specific diameter, preferably a diameter ≤40 μm. Under these conditions, only a good initial mixing is required between the carbon and the liquid, which forms a non toxic slurry. Therefore it is important that the neutralisation subsystem provides a good mixing of the active carbon within the morphine solution. The preferred embodiment for the neutralisation subsystem is the illustrated at picture 5, however other neutralisation systems may be contemplated without departing from the spirit of the invention. By way of non limiting examples, an alternative to a mechanical neutralisation subsystem may be of the pyrotechnic type or by having the neutralising material packaged in a flexible container within the flexible bag, said flexible container being heated or mechanically torn to liberate the neutralising material within the morphine solution. An alternative could consist of a pressurized cartridge containing the neutralising material that is mechanically pierced when neutralisation is needed.

The drug dispenser was disclosed as incorporating a flexible bendable bag 13 containing the medication solution to deliver. This is the preferred embodiment as it avoids any contact with the external environment and is simple to manufacture and to refill but alternative other embodiments may also be foreseen. For example, having a rigid envelope within the container 1 is also possible. It will, however necessitate a second pump in order to pressurise the content of this rigid envelope to allow flushing out of the liquid solution.

Regarding the biometric means, that were disclosed with reference to a fingerprint sensor, they may also be substituted with other biometric technologies like hands, face, iris, retina, voice pattern, signature amongst other.

Lastly, the drug dispenser has been described in relation with the purpose of pain management by allowing the autonomous distribution of oral doses of a morphine solution. It is obvious that the same device may be used for delivering other liquid medications for other applications and conditions. The drug dispenser is perfectly suitable for example for autonomous controlled delivery of liquid methadone to treat patients addicted to narcotics.

This drug dispenser offers many advantages in term of security and ease of use as it allows autonomous medication of patients while insuring that only an enrolled patient may use the dispenser, that doses are accurately and securely delivered and lastly that any attempt to tamper the dispenser will result in the inactivation of its content.

While the invention has been described with reference to a specific embodiment, the description is illustrative of the invention and is not to be construed as limiting the invention. Various modifications may occur to those skilled in the art without departing from the true spirit and scope of the invention as defined by the appended claims.

The invention claimed is:

1. A secure drug dispenser for delivering doses of a liquid medication for oral administration, comprising:

a pressurized airtight container (1) defining a pressurized area (10) in which a flexible bag (13) containing the medication to deliver is arranged, said flexible bag (13) being connected to a valve (20) for delivering a dose through a delivery port (23);

a pressure sensor (27); and within the pressurized area (10), a power supply subsystem (38) and a microcontroller for controlling the valve (20) and for monitoring the pressure within the pressurized area (10).

2. The drug dispenser according to claim 1, wherein the flexible bag (13) containing the liquid medication to deliver comprises a subsystem (16) for neutralizing the medication, said subsystem being activated by the microcontroller (33) when a pressure drop is detected.

3. The drug dispenser according to claim 1, further comprising a micro pump (28) that is adapted to pressurize the pressurized area (10) of the container.

4. The drug dispenser according to claim 1, further comprising biometric identification means (30,35) for authenticating a patient accessing the dispenser.

5. The drug dispenser according to claim 1, wherein the pressurized area (10) of the container (1) is closed with a base plate (3) and locked with a locking mechanism (7,9) that may only be actuated by the microcontroller (33).

6. The drug dispenser according to claim 1, wherein the neutralization subsystem comprises a closed glass pipe (40) filled with a neutralizing material (45) compressed under the action of a spring (41) and an electric actuator connected to a lever system (43,44) for breaking the glass pipe (40) upon activation of the electric actuator.

7. The drug dispenser according to claim 1, wherein the power supply subsystem (38) comprises at least two sets (12) of batteries (46), and a switch allowing the microcontroller (33) to selectively activate one of the sets (12).

8. The drug dispenser according to claim 1, wherein the medication delivered is a solution of morphine sulphate and the neutralizing material (45) comprises high quality active carbon with particle having a diameter ≤40 μm.

9. The drug dispenser according to claim 1, wherein the valve (20) is a bi-stable solenoid valve.

10. The drug dispenser according to claim 1, further comprising a wireless secured communication system that permits remote controlling and monitoring of the drug dispenser.

11. The drug dispenser according to claim 1, further comprising a hollow handle (26) fixed to a body of the container (1) and a recess (25) for holding a delivery cup (24), and wherein spare delivery cups (24) are arranged in a hollow portion of the handle (26).

12. A method of delivering a dose of liquid medication for oral administration to a patient comprising the steps of:

introducing a flexible bag (13) containing a solution of liquid medication to deliver within the airtight area (10) of the drug dispenser according to claim 1, locking and pressurizing the container (1), memorizing biometric parameters of a patient, downloading a prescription scheme into the memory of the microcontroller (33), monitoring the pressure within the container, responding to a patient's solicitation by acquiring his biometric parameters and comparing said parameters to those stored in memory, verifying the timing set in the prescription scheme, in case of a positive match of the last two steps, delivering a dose of medication in conformity with the dosage defined in the prescription scheme, resetting the timing parameters and if necessary activating the pump to compensate the pressure loss induced by the delivery of the dose.

13. The method according to claim 12, further comprising activating the neutralization subsystem in case of a sudden pressure loss or a temperature decrease up to the frozen point of the liquid solution.

* * * * *